US006044926A

United States Patent [19]

Yamane et al.

[11] Patent Number: 6,044,926

[45] Date of Patent: Apr. 4, 2000

[54] MUFFLER FOR SMALL GENERAL-PURPOSE ENGINE

[75] Inventors: Yoshiro Yamane, Akashi; Tsuneyoshi Yuasa, Kobe; Kazuhiko Takemoto; Tadao Yashirodai, both of Kakogawa, all of Japan

[73] Assignee: Kawasaki Jukogyo Kabushiki Kaisha, Japan

[21] Appl. No.: 09/196,012

[22] Filed: Nov. 19, 1998

[30] Foreign Application Priority Data

Nov. 19, 1997 [JP] Japan ..... 9-317980

[51] Int. Cl.[7] ..... F01N 3/02

[52] U.S. Cl. ..... 181/230; 181/231; 181/243; 181/282

[58] Field of Search ..... 181/229, 230, 181/231, 243, 240, 269, 272, 256, 282

[56] References Cited

U.S. PATENT DOCUMENTS 4,854,417 8/1989 Uesugi et al. ..... 181/272
4,858,722 8/1989 Abbe et al. ..... 181/243
4,972,921 11/1990 Takada et al. ..... 181/282

FOREIGN PATENT DOCUMENTS 55-10580 3/1980 Japan .
227129 7/1990 Japan .

*Primary Examiner*—Khanh Dang
*Attorney, Agent, or Firm*—Oppenheimer Wolff & Donnelly LLP

[57] ABSTRACT

A muffler for small general-purpose engine includes a case comprising a pair of case halves coupled together and divided into a first chamber and a second chamber by a partition plate. An inlet of the exhaust gas is provided closer to a first end portion of the case in a first case half. An outlet of the exhaust gas is provided closer to a second end portion of the case in a second case half. A recess projecting from the first chamber toward the second chamber guiding the exhaust gas from the inlet toward the second end portion is provided in the partition plate opposite the inlet. A communication orifice is formed in the partition plate at a location offset from the recess and closer to the first end portion than the inlet.

5 Claims, 3 Drawing Sheets

MUFFLER FOR SMALL GENERAL-PURPOSE ENGINE

BACKGROUND

1. Field of the Invention

The present invention relates to a muffler for a small general-purpose engine, in which a noise reduction chamber is formed by a case having a pair of case halves coupled to each other through their flanges.

A muffler for a small general-purpose engine is disclosed in Japanese Utility Model Publication No. S55-10580, in which a noise reduction chamber is formed by a case having a pair of case halves coupled to each other through their flanges, and directly secured to an engine. In this muffler, one of the case halves having an inlet for introducing the exhaust gas from the engine at the upper portion, and the other case half having an exhaust gas outlet at the lower portion, are coupled to each other by seam welding at flanges of both the case halves to form the case. A vertically extending first guide member of a Ushaped cross section is provided in the case so that the exhaust gas introduced through the inlet is turned downward, and is turned upward by a vertically extending second guide member which is provided downstream of the first guide member and has a U-shaped cross section.

In such a muffler, the exhaust gas from the engine is guided downward by the first guide member immediately after the exhaust gas enters the muffler through the inlet, in a direction substantially perpendicular to the entering direction, and the exhaust gas is then guided upward by the second guide member. This structure causes a large flow resistance to the exhaust gas, restricting the flow of the exhaust gas and lowering the engine output. Providing a curved form of the first guide member, along which the exhaust gas entering the muffler is smoothly guided downward for avoiding this problem, has a drawback in that the muffler is increased in size.

Further, in such a muffler, it is difficult to sufficiently lower the noise level because the exhaust gas expands only once, when it enters the upper noise reducing space in the case from the second exhaust gas passage in the second guide member. Further, the relatively complicated structure of the exhaust gas passage in the muffler, and a seam welding for coupling two case halves, are disadvantageous in terms of cost as for a muffler for a small general-purpose engine.

A muffler of more simple construction and easier to manufacture than that of the above is disclosed in Japanese Utility Model Publication No. H2-27129. More specifically, the interior of the case of the muffler is divided by a partition plate into two chambers, and the case is formed by coupling flanges of the pair of case halves by edge folding, sandwiching a partition plate therebetween to form a muffler of simple construction for easy production, while maintaining noise reduction. However, a need for improvement still remains with regard to such a muffler for a small general-purpose engine, because the edge folding of the case halves and the partition plate for facilitating production may cause a leakage of the exhaust gas which lowers the noise reduction effect and may allow a seeping out of oil in the exhaust gas, depending upon the accuracy of coupling procedure.

An object of the present invention is solving the above problems, and providing a muffler for a small general-purpose engine having a simple structure and an excellent noise reducing effect, in which a pair of case halves are coupled to each other through their flanges to form a noise reduction chamber in the case.

SUMMARY OF THE INVENTION

To achieve the object, the invention provides a muffler for a small general-purpose engine, comprising: a case having a pair of case halves coupled to each other through their flanges; an interior of the case being divided into first and second chambers from front to rear in an entering direction of an exhaust gas from the engine by a partition plate; an inlet for introducing the exhaust gas into the first chamber formed in the first case half at a location closer to a first end of the case in a longitudinal direction perpendicular to the entering direction of the exhaust gas; an outlet for discharging the exhaust gas in the second case half formed at a location closer to a second end of the case in the longitudinal direction; a recess formed in the partition plate at a location opposed to the inlet, the recess being projected toward the second chamber and offset in a lateral direction perpendicular to the entering direction of the exhaust gas and the longitudinal direction of the case, for receiving the exhaust gas introduced into the first chamber through the inlet and for guiding the exhaust gas toward the second end of the case; and a communication orifice formed in the partition plate for communicating between the first and the second chamber at a location offset in the lateral direction with respect to the recess, and offset closer to the first end than the inlet.

In the above structure, when the first end of the case in the longitudinal direction is disposed at an upper side and the second end of the case is disposed at a lower side, the exhaust gas from the engine flows in the muffler along the following passages described. The exhaust gas enters the first chamber through the inlet formed in an upper end portion of the first case half, and flows straightly in the first chamber by the exhaust gas inertia without changing direction into the opposed recess of the partition plate, and is guided downward along the recess into the lower portion of the first chamber. The exhaust gas in the lower portion of the first chamber is pushed aside to the lateral direction, and flow direction is reversed upward toward the communication orifice located at an upward and lateral side of the recess. Then the exhaust gas flows into the second chamber through the communication orifice, and flows downward in the second chamber and is discharged from the outlet provided in the lower end portion of the second case half.

Further, since the interior of the case is divided into the first and second chambers, the exhaust gas is sufficiently throttled when the exhaust gas passes through the communication orifices from the first chamber and expanded largely in the second chamber, to reduce the sound pressure energy. Furthermore, the exhaust gas in the first chamber is guided downward by the recess and then is turned upward, and the exhaust gas flowed into the second chamber through the communication orifice is again guided downward to the outlet of the exhaust gas. The exhaust gas flows through this long passage effectively utilizing the entire inner space of the muffler, during which the pressure of the exhaust gas can be effectively lowered. Thus, the noise level due to the exhaust gas can be effectively lowered.

In the present invention, the recess is provided at a laterally offset location with respect to the case, and the communication orifice is provided at a laterally offset location with respect to the recess. Therefore, a passage of the exhaust gas flowing downward to the lower end portion of the case by the guidance of the recess, and a passage of the exhaust gas flowing upward from the lower end portion of the case toward the communication orifice is laterally juxtaposed in the same first chamber, effectively utilizing the interior space of the first chamber. Further, a greater part of the mainstream of the exhaust gas flowing straightly from the inlet to the recess by the exhaust gas inertia is guided downward along the recess.

In the present invention, it is preferable that the recess has a bottom wall which is inclined toward the second chamber with respect to the direction to the second end of the case, and a peripheral wall of the recess closer to the second end is inclined from a connected portion to the bottom wall toward the opposite direction from the entering direction of the exhaust gas with respect to the direction to the other end. With this structure, the mainstream of the exhaust gas can be directed downward because the exhaust gas introduced in the recess from the inlet is smoothly guided downward along the bottom wall of the recess.

In the present invention, it is preferable that a projected amount of the bottom wall of the recess toward the second chamber is larger than a depth of the first chamber formed by the first case half. With this structure, the mainstream of the exhaust gas introduced into the recess from the inlet smoothly flows downward without dispersion.

Further, a swelling portion projected in a forward-rearward (F-R) direction is formed along the periphery of the partition plate, a bent portion is formed along the peripheral end of a flange of one of the case halves, and a fastening portion is formed along the peripheral end of a flange of the other case halves for covering the swelling portion and the bent portion to secure them under pressure. The swelling portion, the bent portion, and the fastening portion are secured with each other under a high contacting pressure by a spring-back force generated at the swelling portion and the bent portion when these portions are covered and deformed by the fastening portion. Therefore, a reliable connecting condition can be obtained even when the flatness of flanges of the case halves or the periphery of the partition plate is insufficient. As a result, gas leakage from the flange is prevented, and a high noise reduction effect of the muffler is maintained.

BRIEF DESCRIPTION OF THE DRAWINGS

FIG. 2(*b*) is an enlarged front view of the muffler.

DETAILED DESCRIPTION OF THE PREFERRED EMBODIMENTS

A preferred embodiment of the present invention will be explained below with reference to the accompanying drawings.

Figure 1:
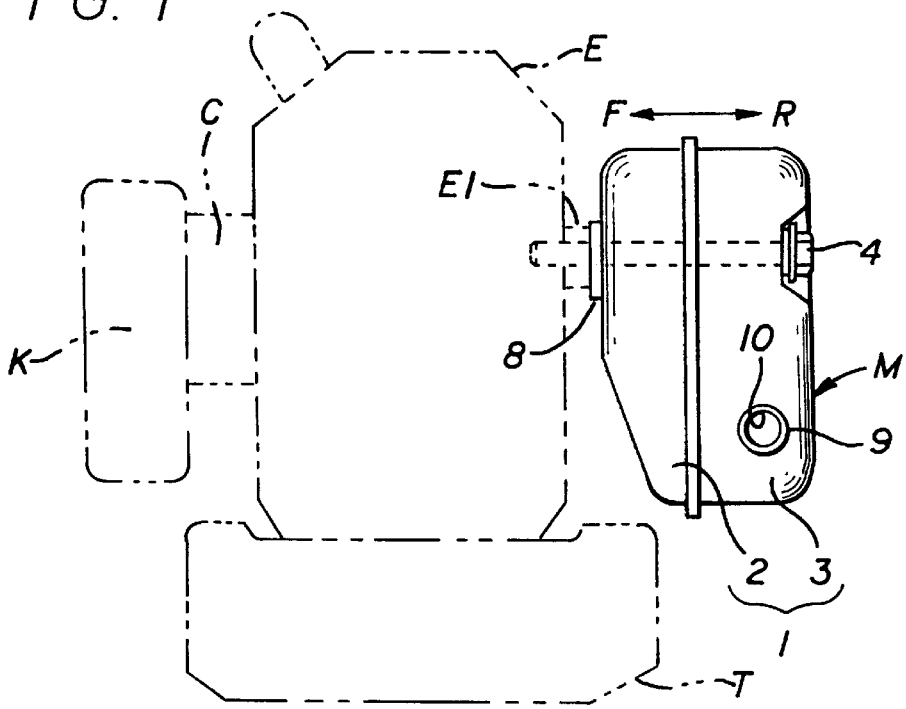
FIG. 1 is a right side view of a muffler according to an fembodiment of the present invention in its mounted state on an engine.

FIG. 1 shows a right side view of a muffler M according to the preferred embodiment of the present invention, in its mounted condition on an engine. A case 1, outer shell of the muffler M comprises a first case half 2 and a second case half 3 coupled to each other through flanges formed at outer peripheries thereof. Details of the coupling structure of the pair of case halves 2 and 3 will be described later. The muffler M is mounted on an engine E above a fuel tank T, at a location opposite to a carburetor C and an air cleaner K, by arranging the first and second case halves 2 and 3 in a forward-rearward (F-R) direction, and by screwing a bolt 4 inserted in the case 1 from the rear into a threaded hole of the engine E.

Figure 2A:
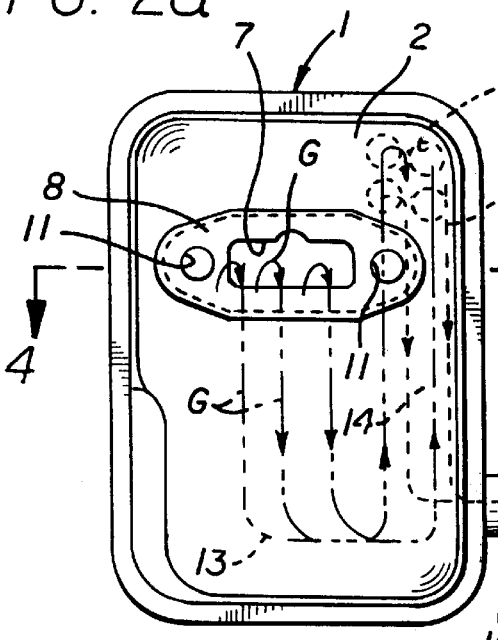
FIG. 2(*a*) is an enlarged rear view of the muffler.
Figure 2B:
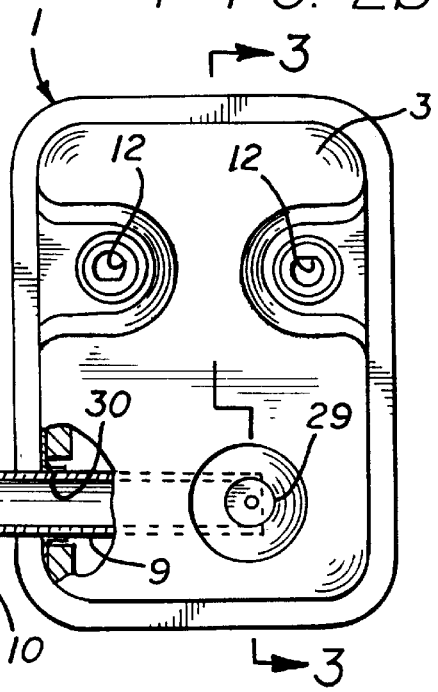

FIG. 2(*a*) shows a front view of the muffler M as viewed from front F, and FIG. 2(*b*) is a rear view of the muffler as viewed from rear R. The muffler M is longer in a longitudinal direction of the case 1 perpendicular to the entering direction of the exhaust gas G from the engine E. In this embodiment, the longitudinal direction coincides with a vertical direction of the muffler M.

As shown in FIG. 2(*a*), an exhaust gas inlet flange 8 having an inlet 7 of the exhaust gas from the engine E is formed at a position close to a first end, i.e., an upper portion of the forwardly arranged first case half 2, and as shown in FIG. 1, the muffler M is mounted to the engine E by connecting the exhaust gas inlet flange 8 to an exhaust flange E1 of the engine E. As shown in FIG. 2(*b*), a discharge pipe 9 for discharging the exhaust gas is mounted to the rearwardly arranged second case half 3, such that the discharge pipe 9 extends from about the central location of the portion close to the a second end, i.e., the central location of the portion of the lower end portion of the second case half 3 to the outside passing through a side wall of the second case half 3, and an exhaust gas outlet 10 is formed by the discharge pipe 9. A pair of insertion holes 11 and 12 for the bolts 4 are formed at the upper portion of the case halves 2 and 3 on both sides of the inlet 7 of the first case half 2. The muffler M is thus secured to the engine E by two bolts 4.

Figure 3:
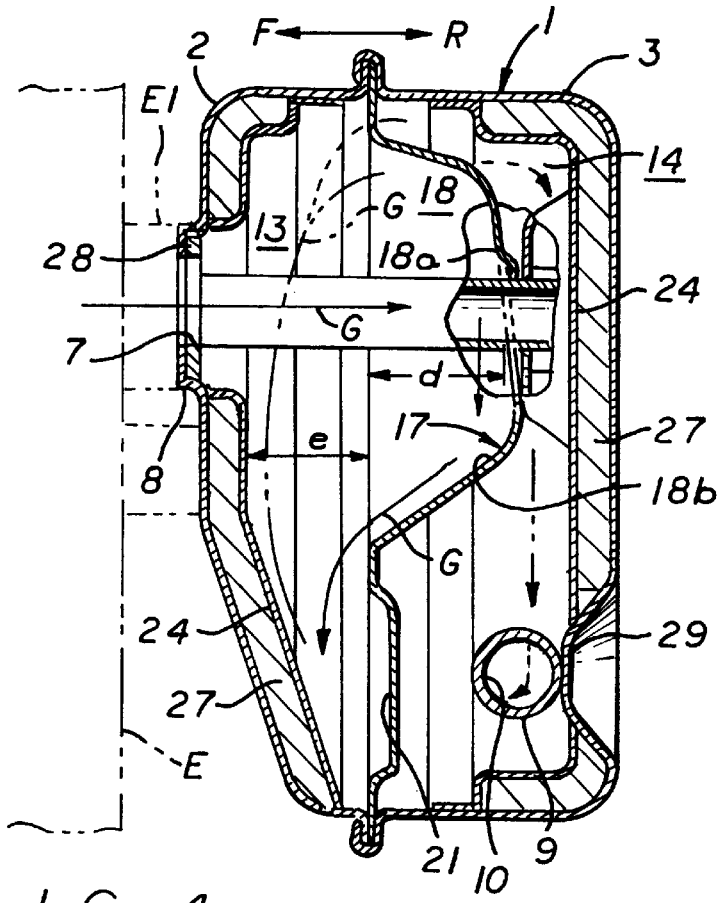
FIG. 3 is an enlarged sectional view taken along the line III—III in FIG. 2(*b*).
Figure 4:
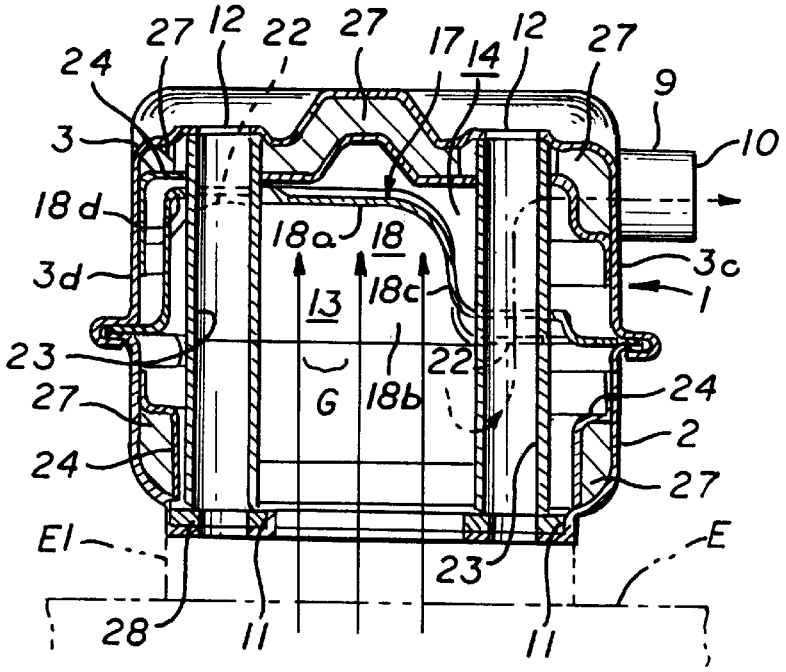
FIG. 4 is an enlarged sectional view taken along the line IV—IV in FIG. 2(*a*)

FIG. 3 is an enlarged sectional view taken along the line III—III in FIG. 2(*b*), and FIG. 4 is an enlarged sectional view taken along the line IV—IV in FIG. 2(*a*). As shown in FIG. 3, an interior space of the case 1 is divided into a first chamber 13 and a second chamber 14 by a partition plate 17 interposed between the pair of case halves 2 and 3 from front to rear in the entering direction of the exhaust gas G from the engine E. Thus, the inlet 7 introduces the exhaust gas G from the engine E into an upper space in the first chamber 13, and the outlet 10 discharges the exhaust gas G passed through the case 1 from a lower portion of the second chamber 14.

A recess 18 projecting toward the second chamber 14 is formed on the partition plate 17 at the opposed portion to the inlet 7. An amount of projection "d" of a bottom surface 18*a* of the recess 18 toward the second chamber 14 is set longer than a depth "e" formed in the first chamber 13 of the first case half 2 in the forward-rearward (F-R) direction. In this embodiment, the bottom wall 18*a* of the recess 18 extends to the vicinity of a lath metal 24 provided on an inner side of the second case half 3 as will be described later. Further, the bottom wall 18*a* is inclined toward the second chamber 14 with respect to the direction toward the second end, i.e., slightly inclined rearward to the second chamber 14 with respect to the downward direction. A lower peripheral wall 18*b* of the recess 18 which is connected downwardly to the bottom wall 18*a* of the recess 18 in the partition plate 17 is inclined from the connected portion toward the opposite direction from the entering direction of the exhaust gas G with respect to the downward direction, i.e., inclined forwardly from the connected portion of the bottom wall 18*a* of the recess 18.

As shown in FIG. 4, the recess 18 is provided at a position offset toward one of the lateral directions (leftward, in FIG. 4) perpendicular to both the entering direction of the exhaust gas and the longitudinal direction. That is, one side peripheral wall 18*c* of the recess 18 is largely spaced apart from one side wall 3*c* of the second case half 3, and the other side peripheral wall 18*d* is located close to the other side wall 3*d*. An exhaust gas passage in the second chamber 14 is formed between the side peripheral wall 18*c* and the side wall 3*c* of the second case half 3, and the side peripheral walls 18*c* and 18*d* are formed as guide walls for guiding the exhaust gas downward in the first chamber 13.

Figure 5A:
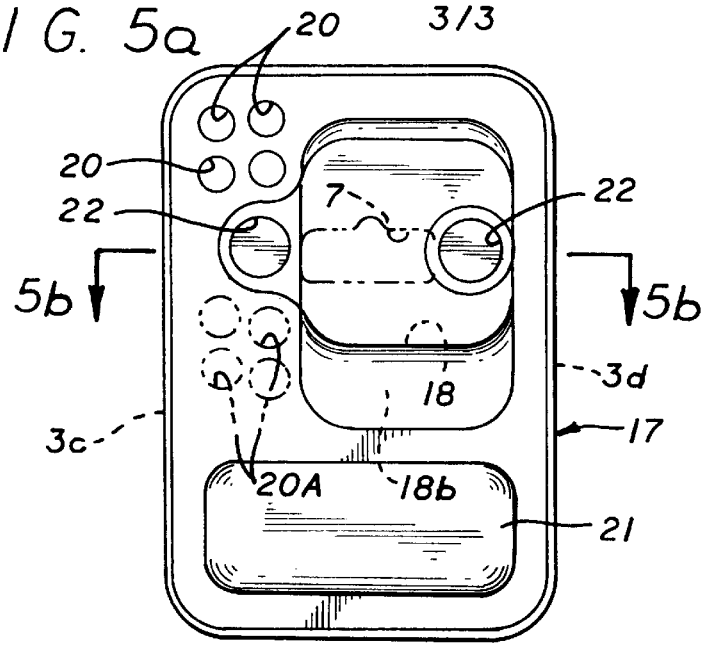
FIG. 5(*a*) is a rear view of a partition plate of the muffler, and FIG. 5(*b*) is a sectional view taken along the line B—B in FIG. 5(*a*).
Figure 5B:
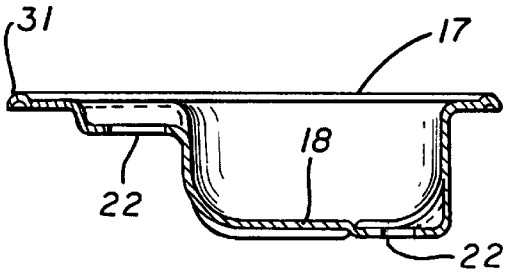

FIG. 5(*a*) is a rear view of the partition plate 17, and FIG. 5(*b*) is a sectional view taken along the line B—B in FIG. 5(*a*). As can be seen in FIG. 5(*a*), a plurality (four in the present embodiment) of communication orifices 20 are formed in the partition plate 17 at a location offset to one of the lateral directions (close to the one side wall 3*c*) with respect to the recess 18, and located upward (close to the first end) of the inlet 7 (shown in two-dotted line in FIG. 5(*a*)) of the first case half 2, i.e., an upwardly and laterally remote location with respect to the recess 18. Further, as shown in FIG. 3, a lower projection 21 is formed in the partition 17 below the lower peripheral wall 18*b*. The lower projection 21 extends laterally and projects slightly toward the discharge pipe 9 in the second chamber 14.

A pair of insertion holes 22, 22 are formed in the partition plate 17 at locations opposed to the insertion holes 11 and 12 of the case halves 2 and 3, through which a reinforcing pipe 23 is inserted for receiving a fastening force of the bolt 4 (FIG. 1) when the case 1 is mounted to the engine E. Each reinforcing pipe 23 is positioned to coincide its opposite opening ends with the insertion holes 11 and 12 of both the case halves 2 and 3, and is fastened and secured from both sides by the case halves 2 and 3. The bolt 4 shown in FIG. 1 is inserted through the reinforcing pipe 23 and screwed into the engine E.

The mesh-like lath metals 24 are disposed on inner sides of both case halves 2 and 3 at predetermined distances from the inner surface of case halves 2 and 3, and peripheral portions of the lath metals 24 are secured to the inner surface of the case halves 2 and 3 by spot welding. Glass wool 27 is filled in a space between the case halves 2, 3 and the lath metals 24. The glass wool 27 enhances a noise reducing effect of the exhaust gas G. A reinforcing plate 28 is fitted into the inner side of the inlet flange 8 and secured by the reinforcing pipe 23. As shown in FIG. 2(*b*), one end of the exhaust pipe 9 is inserted through and held at an opening 30 of a barring hole in the second case half 3, and the exhaust pipe 9 is spot welded to a projection 29 (FIG. 3) formed in the lower portion of the second case half 3.

Figure 6A:
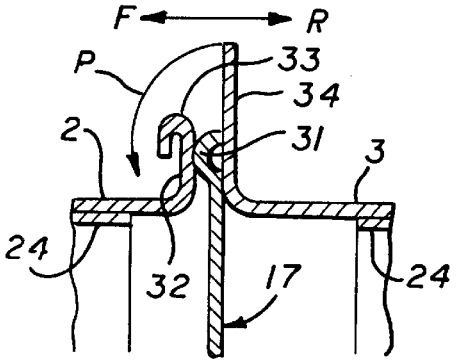
FIG. 6(*a*) is an enlarged partial sectional view of a case before it is assembled, and FIG. 6(*b*) is an enlarged partial sectional view of the assembled case.
Figure 6B:
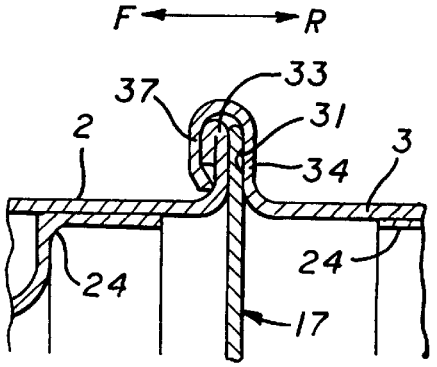

A coupling structure of the case 1 will now be explained with reference to FIG. 6. As shown in FIG. 6(*a*), a swelled portion 31 projected forward F in an arc-shape is formed along the entire length of periphery of the partition plate 17. A bent portion 33 is formed to overlap along the entire length of the peripheral end of the flange 32 of the first case half 2 by bending the peripheral end in 180 degrees. When the case 1 is assembled, the swelled portion 31 of the partition plate 17 is interposed between the flanges 32 and 34 of the case halves 2 and 3, such that the swelled portion 31 of the partition plate 17 and the bent portion 33 of the first case half 2 are abutted against each other. Keeping this abutted state, the flange 34 of the second case half 3 is bent in a direction of the arrow P to enclose the swelled portion 31 and the bent portion 33, and the flange 34 is subjected to caulking (crimping). By the crimping, a fastened portion 37 is formed on the flange 34 as shown in FIG. 6(*b*). The fastened portion 37 covers the expanded portion 31 and the bent portion 33 to press contact under pressure in the forward-rearward (F-R) direction, and both the case halves 2 and 3 as well as the partition plate 17 interposed therebetween are coupled integrally to form the case 1.

In the case 1 constructed as described above, a firm connection is obtained, because the swelled portion 31 and the bent portion 33 are elastically deformed in the forward-rearward (F-R) direction so that the bent portion 33 and the swelled portion 31 are tightly contacted by spring-back forces which repulse each other, when the fastened portion 37 is formed by folding and crimping the flange portion 34 of the second case half 3. Therefore, unlike connecting means such as conventional edge-folding, this case 1 can be fabricated firmly by connecting the case halves 2, 3 and the partition plate 17 to each other under high sealing pressure, even when a flatness of each of the flanges 32 and 34 of the case halves 2 and 3 as well as the periphery of the partition plate 17 is otherwise insufficient. With this connection, leakage from the connected portion of flanges 32 and 34 is prevented, maintaining the noise reducing effect of the muffler at a high level. Further, seeping out of oil in the exhaust gas is also prevented. Still further, the structure of the joint connecting the partition plate and case halves is simple, because this structure is obtained by providing the swelled portion 31 with the partition plate 17, the bent portion 33 with one case half, and the fastening portion with the other case half for covering the swelled portion 31 and the bent portion 33.

Operation of the muffler M will now be explained. The exhaust gas G from the engine E shown in FIG. 3 flows in the muffler through the following passages. As shown in arrows FIGS. 2 to 4, the mainstream of the exhaust gas G from the engine is introduced in the first chamber 13 through the inlet 7 formed in the upper portion of the case 1, and flows straightly within the first chamber 13 in a horizontal direction by inertia of the exhaust gas without changing the flowing direction into the recess 18 of the partition plate 17. Here, the projected amount "d" of the bottom wall 18*a* of the recess 18 toward the second chamber 14 is set longer than the depth (length in the F-R direction) "e" of first case half 2 which forms the first chamber 13, and the mainstream of the exhaust gas G flowing into the recess 18 flows downward without dispersing outside. Further, the impact speed of the exhaust gas G against the bottom wall 18*a* is moderated, because the projected amount "d" of the recess 18 is set as long as possible in the second case half 3, and the flowing direction of the exhaust gas G can be changed smoothly within the recess 18.

The mainstream of the exhaust gas G in the recess 18 is guided downward smoothly without dispersing in lateral directions by the side peripheral walls 18*c* and 18*d* of the recess 18, and the bottom wall 18*a* of the recess 18 having a downward inclination toward the rearward direction R, and also by the lower peripheral wall 18*b* having a downward inclination toward the forward direction F. Because the communication orifices 20 are disposed at an upward and laterally offset location with respect to the recess 18, as shown in FIG. 5, the mainstream of the exhaust gas G introduced in the first chamber 13 through the inlet 7 is guided downward by the recess 18 as shown by arrows in FIG. 3, and only a small portion of the exhaust gas G in the recess 18 flows directly to the communication orifices 20.

Arrows with a two-dotted line in FIG. 2(*a*), indicate the flowing direction of the exhaust gas G from the inlet 7 to the communication orifices 20 by way of the recess 18 (FIG. 3).

The mainstream of the exhaust gas G is guided downward by the side peripheral walls 18*c* and 18*d* of the recess 18 without dispersing laterally, and then flows into a narrow space of the front lower portion of the first chamber 13 surrounded by a lower portion of the first case half 2 and the lower projection 21 of the partition plate 17 as shown in FIG. 3. The mainstream in the narrow space directly below the recess 18 is pushed laterally to the right as shown in FIG. 2(*a*), and changes its direction upward toward the communication orifices 20, the only exit of the first chamber 13, and flows into the second chamber 14 through the communication orifices 20. The exhaust gas mainstream flows along outside of the side peripheral wall 18*c* of the partition plate 17 projected into the second chamber 14, and flows downward in the second chamber 14 and enters into the exhaust pipe 9, and is discharged from the outlet 10 of the exhaust pipe 9 as shown with arrows with dotted line in FIG. 2(*a*).

As for the passages of the exhaust gas G within the case 1, because the interior of the case 1 is divided into the first chamber 13 and the second chamber 14 by the partition plate 17, as shown in FIG. 3, the exhaust gas G in the first chamber 13 is sufficiently throttled at the communication orifices 20 (FIG. 2(*a*)), and is expanded largely in the second chamber 14. Sound pressure energy of the exhaust gas G is remarkably reduced. Further, the exhaust gas G introduced into the first chamber 13 is, at first, guided downward by the recess 18 into the lower portion of the case 1, and then changes its flowing direction upward to the upper portion, and flows into the second chamber 14 through the communication orifices 20, and again flows downward within the second chamber 14, and thus the exhaust gas G flows along a long passage effectively utilizing the entire space within the case 1. Therefore, the noise level due to the exhaust gas G can be effectively reduced, because the pressure of the exhaust gas G can be reduced effectively while it flows through the long passage.

Further, in this muffler, the passage of the exhaust gas flowing downward to the lower end portion of the case 1 by the guidance of the recess 18 (FIG. 3), and the passage of the exhaust gas flowing upward from the lower end portion of the case 1 to the communication orifices 20 can be laterally juxtaposed within the same first chamber 13 as shown in FIG. 2(*a*). Although the flowing direction is reversed in the lower end of the first chamber 13, the exhaust gas G can flow smoothly. Still further, the structure of the muffler M is extremely simple, because the long passage for the exhaust gas in the muffler M is formed by dividing the interior of the case 1 by the partition plate 17 having the recess 18.

When a power increase of the engine E is required, other communication orifices 20A shown in phantom lines in FIG. 5(*a*) may be provided at a lower portion of the inlet 7, in addition to the communication orifices 20 shown in solid lines.

In the embodiment described above, the exhaust gas G from the engine E is introduced from the inlet 7 near the upper end portion of the case 1. However, the same effect can be obtained by a structure wherein the exhaust gas G is introduced at the lower portion of the case 1 and is discharged at the upper portion of the case 1. In this case, the above described muffler M is vertically inverted.

Numerous modifications and alternative embodiments of the present invention will be apparent to those skilled in the art in view of the foregoing description. Accordingly, this description is to be construed as illustrative only, and is provided for the purpose teaching those skilled in the art the best mode of carrying out the invention. The details of the structure and/or function may be varied substantially without departing from the spirit of the invention and all modifications which come within the scope of the appended claims are reserved.

What is claimed is:

1. A muffler configured for use with a small general-purpose engine, comprising:

a case having a first end and a second end, the case further comprising a pair of case halves, each of said case halves having flanges, said case halves being coupled to each other through their flanges;

a partition plate joined to the case halves at said flanges, an interior of the case being divided into first and second chambers from front to rear in an order encountered in an entering direction of an exhaust gas from the engine by a partition plate;

an inlet for introducing the exhaust gas in an entering direction into the first chamber formed in the first case half at a location closer to the first end of the case in a longitudinal direction perpendicular to the entering direction of the exhaust gas than to the second end, an outlet for discharging the exhaust gas in the second case half formed at a location closer to the second end of the case in the longitudinal direction than to the first end;

a recess formed in the partition plate at a location opposed to the inlet, the recess being projected toward the second chamber and offset in a lateral direction perpendicular to the entering direction of the exhaust gas and the longitudinal direction of the case, for receiving the exhaust gas introduced into the first chamber through the inlet and for guiding the exhaust gas toward the second end of the case; and a communication orifice formed in the partition plate for providing communication between the first and the second chamber at a location offset in the lateral direction with respect to the recess, and offset closer to the first end than the inlet.

2. A muffler for a small general-purpose engine according to claim 1, wherein the recess has a bottom wall which is inclined toward the second chamber with respect to the direction toward the second end of the case, and a peripheral wall of the recess closer to the second end is inclined from a connected portion to the bottom wall toward the opposite direction from the entering direction of the exhaust gas with respect to the direction to the second end.

3. A muffler for a small general-purpose engine according to claim 2, wherein a projected amount of the bottom wall of the recess toward the second chamber is larger than a depth of the first chamber formed by the first case half.

4. A muffler for a small general-purpose engine according to claim 1, wherein a swelled portion is formed along the periphery of the partition plate projected in a forward-rearward direction, a bent portion is formed along the peripheral end of a flange of one of the case halves, and a fastening portion is formed along the peripheral end of a flange of the other case half for covering the swelling portion and the bent portion to secure them under pressure.

5. A muffler for a small general-purpose engine, comprising:

a case further comprising a pair of case halves having peripheral flanges, said case halves defining an interior of the case when coupled, and said case halves being coupled to each other through their flanges, the interior of the case being divided into first and second chambers in order encountered from a forward side to a rearward side in an entering direction of an exhaust gas from the engine by means of a partition plate; wherein a swelled portion is formed along the periphery of the partition plate projected in a forward-rearward direction, a bent portion is formed along the peripheral end of a flange of one of the case halves, and a fastening portion is formed along a peripheral end of a flange of the other case half for covering the swelling portion and the bent portion to secure them under pressure.

* * * * *